United States Patent [19]

Benson et al.

[11] 3,937,467

[45] Feb. 10, 1976

[54] BILLIARD BALL

[75] Inventors: Richard W. Benson, Delmar; John R. Crnak, Mechanicville; Richard G. Ingraham, Delmar, all of N.Y.

[73] Assignee: Albany International Corporation, Albany, N.Y.

[22] Filed: Mar. 10, 1975

[21] Appl. No.: 556,621

Related U.S. Application Data

[63] Continuation of Ser. No. 412,965, Nov. 5, 1973.

[52] U.S. Cl. ..... 273/59 R; 264/328; 264/299; 40/327

[51] Int. Cl.[2] ..... A63B 37/00

[58] Field of Search ..... 273/59; 40/327

[56] References Cited

UNITED STATES PATENTS

| | | | |
|---|---|---|---|
| 507,880 | 10/1893 | Burt | 273/59 R X |
| 517,972 | 4/1894 | Burt | 273/59 R |
| 652,993 | 3/1900 | Burt | 273/59 R X |
| 690,861 | 1/1902 | Hoyt | 273/59 R X |
| 3,228,686 | 1/1966 | Faulkner | 273/59 R |

*Primary Examiner*—George J. Marlo

[57] ABSTRACT

An improved billiard ball is provided comprising a major portion and a minor portion together forming a solid, spherical body. The minor portion is preformed with inclined surfaces which define an interlock adapted to cooperate with associated surfaces of the major portion to form a mechanical bond between the major and minor portions after the major portion is formed about the minor portion. When the minor portion is molded in the shape of a bracelet, a slit may be provided therein to relieve stresses caused by shrinkage during cooling.

5 Claims, 8 Drawing Figures

BILLIARD BALL

This is a continuation of application Ser. No. 412,965, filed Nov. 5, 1973.

BACKGROUND OF THE INVENTION

The present invention relates to billiard balls and in particular to an improved method of making a molded billiard ball utilizing thermoset resins and the product thereof.

The game of billiards and its several variations have been played and enjoyed for hundreds of years. Prior to the Civil War, all billiard balls were made of ivory. About that time, the demand for ivory became much greater than the supply and the principal domestic importer and distributor of billiard balls offered a reward of $10,000 to anyone who developed a high quality ball made out of anything other than ivory. As a result, the plastic composition billiard ball was developed.

Over the years many improvements were made in the art of manufacturing billiard balls. The major improvement came shortly after World War II with the introduction of the cast resin billiard ball. The casting method produces an extremely high quality ball, but entails a rather expensive manufacturing process. There was also developed an injection molding method of forming billiard balls utilizing expanded thermoplastic injection molding techniques. The injection molding method entails a shorter manufacturing process than the cast resin process but does not produce a ball of the caliber of a cast ball because of internal voids and the lack of other quality characteristics caused by the use of thermoplastic resins in this process. The internal voids in an injection molded thermoplastic ball unbalances the ball as a result of which it will not interact with other balls in a precisely predictable fashion and will not roll straight or true even on a good quality table. For this reason, all quality billiard balls have been formed by the expensive cast resin technique heretofore.

The familiar billiard ball set consists of 16 balls; one all white (the cue ball), eight of various solid colors with a pair of opposed white inserts bearing numbers (the 1–8 balls), and seven white balls with stripes of varying colors bearing numbers on the stripes (the 9–15 balls).

It is the principal object of the present invention to provide an improved numbered billiard ball having the high quality of conventional cast resin balls and some of the cost savings of injection molded balls.

SUMMARY OF THE INVENTION

The above and other beneficial objects and advantages are attained in accordance with the present invention by providing a billiard ball comprising a major portion and a minor portion which together form a solid, spherical body. The minor portion comprises an insert of the same formulation as the major portion and includes surfaces thereon defining a mechanical interlock adapted to cooperate with associated surfaces of the major portion in forming a secure mechanical bond between the major and minor portions after the major portion of the ball is molded about the insert. The interlock includes two surfaces on opposite sides of a diameter which are inclined toward each other. The major portion when formed shrinks into tight engagement with these inclined surfaces to form a tight mechanical bond.

The present invention also contemplates a method of manufacturing a billiard ball of the type described above which includes the step of forming the minor portion of a cured plastic resin so as to include therein a pair of opposed interlocks. The minor portion is then placed in a spherical mold cavity and additional plastic resin of the same formulation but of a different color is added to the mold whereafter the mold is subjected to heat and pressure. The ball is then removed from the mold and permitted to cool causing the additional plastic resin, which comprises the major portion of the finished ball, to shrink against the minor portion thereby forming a tight mechanical bond with the minor portion interlock.

BRIEF DESCRIPTION OF THE DRAWINGS

The present invention is disclosed in the accompanying drawings wherein.

DETAILED DESCRIPTION OF THE PREFERRED EMBODIMENTS

Figure 2:
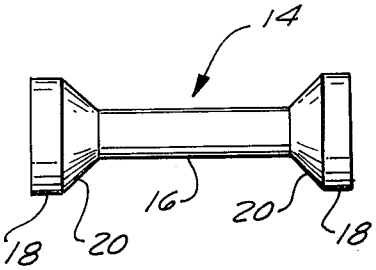
FIG. 2 is a perspective view of the minor portion insert for a "solid" billiard ball in accordance with the present invention.
Figure 3:
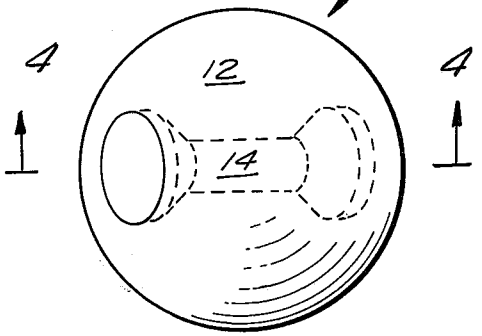
FIG. 3 is a perspective view of a "solid" billiard ball in accordance with the present invention depicting, in phantom, the minor portion insert in position.
Figure 4:
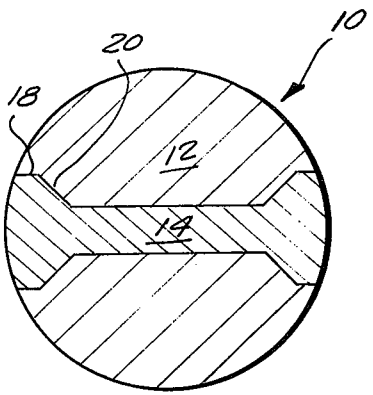
FIG. 4 is a sectional view along reference lines 4—4 of FIG. 3 in the direction indicated by the arrows.

The present invention is illustrated in the accompanying drawings wherein similar components bear the same reference numeral throughout the several views. As stated, there are two types of numbered billiard balls, the 1–8 balls which are solid with two white circles centered approximately 180° apart from each other and the 9–15 balls which are white and carry a colored stripe or band that encircles the circumference of the ball. An identifying number is positioned in the white circles of the 1–8 balls and similarly there are two white circles centered approximately 180° apart from each other on the colored stripe of the 9–15 balls with an identifying number lying within each of these circles. The 1–8 balls which hereinafter will be referred to as being a "solid" ball, are depicted in FIGS. 2 through 4. The 9–15 balls which hereinafter will be referred to as being a "stripe" ball are illustrated in FIGS. 5 through 8.

Referring first to FIGS. 2 through 4, there is shown a solid ball 10 in the form of a solid, spherical body comprising a major portion 12 and minor portion 14. Both the major and minor portions are formed of the same thermosetting plastic resin material although colored differently. In this connection, the minor portion is usually white and the major portion, a color.

Referring to FIG. 2, it can be seen that the minor portion 14 comprises an elongated shaft or rod 16 having enlarged cap portions 18 at either end. A tapering surface 20 extends between the ends of shaft 16 and caps 18. Referring briefly to FIG. 4, it can be seen that the minor portion 14 extends along a diameter of the ball with the tapered surfaces 20 extending about the diameter so that portions of the tapering surface are on opposite sides of the diameter.

The tapering surface 20 of the minor portion defines an interlock which cooperates with the associated surfaces of the major portion to form a mechanical bond between the major and minor portions. That is, the major and minor portions are securely held to one another along the entire length of the interlock by the physical inability of the major and minor portions to move with respect to one another due to the interference of the interlock. It should also be noted that the insert 14 extends through the major portion 12 so that the cap portions 18 both extend to and form a portion of the surface of the final, solid, spherical billiard ball. These cap portions form the white circles on which a numeral between 1 and 8 can be positioned in a manner which will be described in more detail forthwith.

Figure 5:
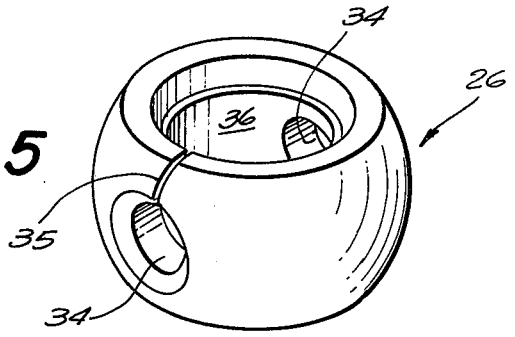
FIG. 5 is a perspective view of a minor portion insert for a "striped" billiard ball in accordance with the present invention.
Figure 6:
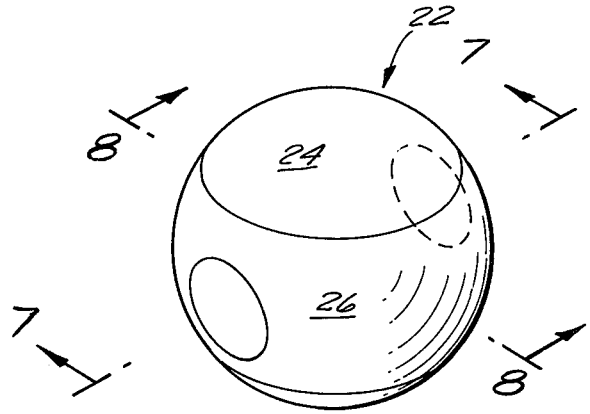
FIG. 6 is a perspective view of a "striped" billiard ball in accordance with the present invention.
Figure 7:
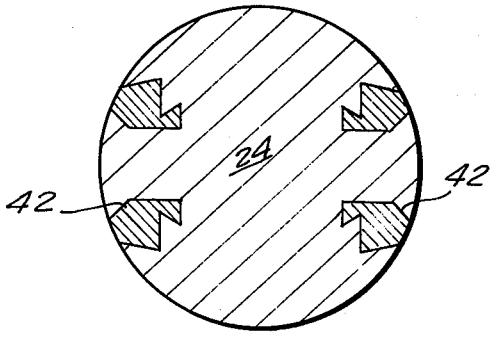
FIG. 7 is a sectional view taken along reference lines 7—7 of FIG. 6 in the direction indicated by the arrows.

A "stripe" ball 22 in accordance with the present invention is depicted in FIG. 6. As with the solid ball, the stripe ball comprises a major portion 24 and minor portion 26 which forms an insert for the major portion to complete the spherical body of the final billiard ball. The minor portion 26 is depicted in FIG. 5 and, as shown, comprises a bracelet-shaped member having an outer surface 28, an inner surface 30 and a pair of opposed side walls 32 extending between the inner and outer surfaces. The bracelet is formed of a cured thermosetting plastic resin of the same formulation as the major portion except that the major portion is now white and the bracelet, a color. A pair of holes 34 extend completely through the bracelet approximately 180° apart from each other. In addition, a central opening 36 extends through the bracelet from side wall to side wall. A slit 35 may be provided in the bracelet as shown to relieve stresses caused by shrinkage during cooling. The slit relieves any tendency of the material to crack during cooling. If cracks do occur they will be in the area of the slit and will be covered by the major portion so as not to be visible.

Figure 8:
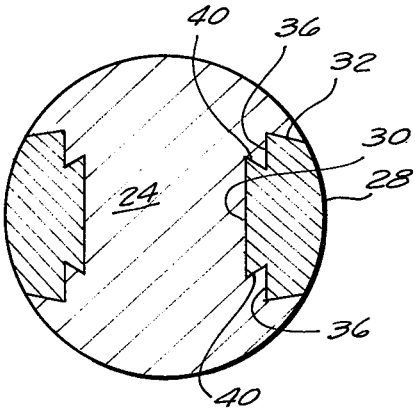
FIG. 8 is a sectional view taken along reference lines 8—8 of FIG. 6 in the direction indicated by the arrows.

Referring to FIG. 8, it can be seen that a pair of recesses 36 extend toward each other from the side walls 32 intermediate the inner and outer surfaces. In addition, an inclined surface 40 extends between the inner surface 30 and the base of each recess 36 in a dove-tail manner in section, as shown. The inclined surfaces 40 extend about a diameter through the billiard ball and forms an angle of 60° with the diameter. Thus, portions of the inclined surface are opposite each other. As with the solid ball, the inclined section 40 of the stripe ball defines a mechanical interlock which cooperates with associated surfaces of the major portion to form a firm mechanical bond between the major and minor portions which prevents any relative movement between the two.

It should also be noted that holes 34 extending through the bracelet terminate in a tapered section 42 which extends to the outer surface. The tapered section 42 is inclined at an angle of approximately 45° to the central diameter extending between the opposed holes. The tapered portions 42 form an additional mechanical interlock which cooperates with associated surfaces of the major portion to mechanically bond the major and minor portions to one another.

Figure 1:
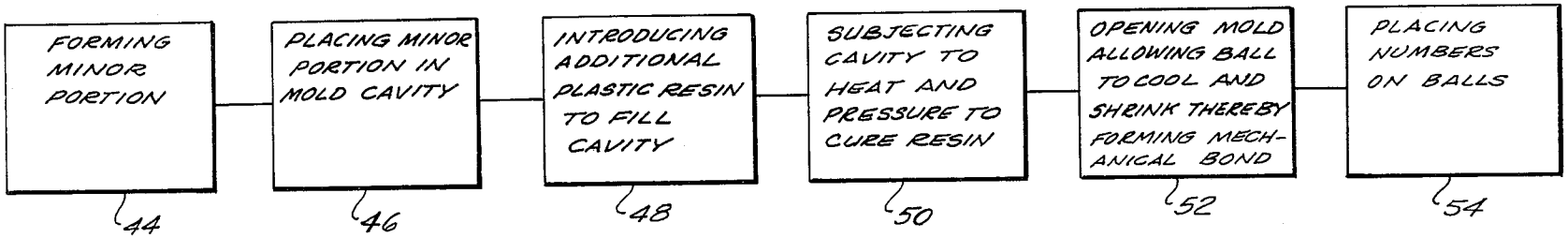
FIG. 1 is a block diagram depicting the manner of manufacturing the improved billiard balls of the present invention.

The method of forming the improved billiard balls of the present invention is set out in FIG. 1. Accordingly, as a first step, the minor portion (insert 14 or bracelet 26) is formed of a cured thermosetting plastic resin as shown in block 44. The minor portion may be machined or molded although the latter procedure is the most desirable because of the short time required and hence the economics involved. Immediately after molding the minor portion and while it is still plastic it is placed in the cavity of a spherical mold and the mold is closed as represented by block 46. Hot plastic resin of the same formulation as the minor portion is then introduced into the mold and dispersed by means of heat and pressure to flow around the insert and completely fill the mold cavity as shown in block 48. The mold is then left closed under heat and pressure for a predetermined period of time to enable the raw resin to cure and thereby shrink around the insert to form a ball. This step is represented by block 50. Pouring the major portion while the minor portion is still hot and plastic helps relieve stresses and thus the danger of cracks while the ball cools.

The next step of the process is represented by block 52. In this step the mold is opened after the curing cycle is completed and the ball is removed from the mold and set aside to cool. During the cooling process further shrinkage of the material occurs whereby the mechanical bond between the major and minor portion is formed. The final step in the formation of the billiard ball is illustrated in block 54. In connection hereto each ball has numerical indentations on opposite sides of the ball which have been molded into the major portion of the striped balls and the minor portion of the solid balls in step 50 and step 44 respectively. In step 54 the indentations on one side of the balls are filled with a black resin and then partially cured to prevent running while the opposite indentations are filled. Thereafter the numbers on both sides are completely cured. In the next operation, the balls are rough-ground to remove excess material and then ground on a centerless fine grinder to produce the final spherical shape and size. As a final process, the balls are buffed and then packed and shipped.

Thus, in accordance with the above, the aforementioned objects are effectively attained.

Having thus described the invention, what is claimed is:

1. A billiard ball comprising: a major portion formed of a thermosetting plastic and a minor portion of thermosetting plastic together forming a solid spherical body; said minor portion comprising a bracelet having surfaces thereon defining a mechanical interlock adapted to cooperate with associated surfaces of said major portion in forming a mechanical bond between said major and minor portions, said bracelet having an outer surface, a substantially flat inner surface, a pair of opposed circular openings extending through the bracelet perpendicular to the bracelet axis, each of said openings extending on opposite sides of a diameter of said ball from said inner surface toward said outer surface to a first position and then flaring out at a taper from said first position to said outer surface, a pair of sides connecting said inner and outer surfaces, a pair of recesses intermediate said inner and outer surfaces formed by a pair of diametrically opposed surfaces extending toward each other from said sides, and said interlock comprises two surfaces extending between said opposed surfaces and said flat surface inclined toward each other and converging away from the center of the ball.

2. The billiard ball in accordance with claim 1 wherein said minor portion insert is formulated of the same thermosetting plastic as said major portion.

3. The billiard ball in accordance with claim 1 wherein said major and minor portions are of different colors.

4. The billiard ball in accordance with claim 1 wherein the taper from said first position to said outer surface is at 45°.

5. A billiard ball comprising: a major portion formed of a thermosetting plastic and a minor portion of thermosetting plastic together forming a solid spherical body; said minor portion comprising a bracelet having surfaces thereon defining a mechanical interlock adapted to cooperate with associated surfaces of said major portion in forming a mechanical bond between said major and minor portions, said bracelet having an outer surface, a substantially flat inner surface, a pair of opposed circular openings extending through the bracelet perpendicular to the bracelet axis, each of said openings extending on opposite sides of a diameter of said ball from said inner surface toward said outer surface and flaring out at a taper to said outer surface, a pair of sides connecting said inner and outer surfaces, a pair of recesses intermediate said inner and outer surfaces formed by a pair of diametrically opposed surfaces extending toward each other from said sides, and said interlock comprises two surfaces extending between said opposed surfaces and said flat surface inclined toward each other and converging away from the center of the ball.

* * * * *